United States Patent [19]

Carolla

[11] Patent Number: 4,820,620

[45] Date of Patent: Apr. 11, 1989

[54] SUPERSENSITIZATION OF AND REDUCTION OF DARK DECAY RATE IN PHOTOCONDUCTIVE FILMS

[75] Inventor: Donald J. Carolla, St. Paul, Minn.

[73] Assignee: Minnesota Mining and Manufacturing Company, St. Paul, Minn.

[21] Appl. No.: 115,695

[22] Filed: Nov. 2, 1987

Related U.S. Application Data

[63] Continuation-in-part of Ser. No. 887,074, Jul. 17, 1986, abandoned.

[51] Int. Cl.[4] ..... G03G 5/04

[52] U.S. Cl. ..... 430/84; 430/96

[58] Field of Search ..... 430/84, 90, 96

[56] References Cited

U.S. PATENT DOCUMENTS

| | | | |
|---|---|---|---|
| 2,959,481 | 12/1958 | Kucera | 96/1 |
| 3,051,569 | 8/1962 | Sugarman et al. | 96/1 |
| 3,128,179 | 4/1964 | Kendall et al. | 96/1 |
| 3,274,000 | 1/1965 | Noe et al. | 96/1.5 |
| 3,403,023 | 5/1965 | Carrington | 96/1.7 |
| 3,469,979 | 11/1965 | Ferrarini | 96/1.7 |
| 3,563,734 | 8/1967 | Shely | 96/1.4 |
| 3,619,154 | 9/1971 | Cavagna | 96/1.7 |
| 3,682,630 | 8/1972 | Park | 96/1.6 |
| 3,764,313 | 10/1973 | Shely | 96/1.5 |
| 3,867,144 | 2/1975 | Lee | 96/1.7 |
| 3,881,925 | 5/1975 | Uchida et al. | 96/1.8 |
| 4,377,629 | 3/1981 | Tarumi et al. | 430/62 |
| 4,418,135 | 9/1982 | Beeson | 430/93 |
| 4,539,282 | 12/1983 | Morimoto et al. | 430/59 |
| 4,640,879 | 2/1987 | Simons et al. | 430/96 |

OTHER PUBLICATIONS

Commonly assigned U.S. patent application Ser. No. 887,073, filed Jul. 17, 1986. Discussed at p. 8, lines 22–28, and at p. 16, lines 26–28.

P. 352, Schaffert, *Electrophotography*, 2nd edition, Wiley & Sons, New York, New York, 1975. Discussed at p. 3, lines 27–34.

Aldrich Material Safety Data Sheet on CAS #81–88–9, published by Aldrich Chemical Company on Sep. 14, 1984. Discussed at p. 4, lines 7–11.

*Primary Examiner*—John L. Goodrow

*Attorney, Agent, or Firm*—Donald M. Sell; Walter N. Kirn; Robert H. Jordan

[57] ABSTRACT

A photoconductive film comprising at least one photosensitive material dispersed in a resinous binder is supersensitized and the dark decay rate thereof reduced by adding an effective amount of an organic acid having at least one carboxyl functional group and at least one hydroxyl functional group to the coating mixture from which the film is formed. The organic acid is an independent component of the coating mixture and is substantially not copolymerized with the binder resin.

20 Claims, No Drawings

SUPERSENSITIZATION OF AND REDUCTION OF DARK DECAY RATE IN PHOTOCONDUCTIVE FILMS

CROSS REFERENCE TO RELATED APPLICATION

This application is a continuation-in-part of application Serial No. 887,074, filed July 17, 1986 now abandoned.

FIELD OF INVENTION

This invention concerns photoconductive films comprising a photosensitive material dispersed in a resinous binder and, more specifically, the spectral sensitization of such photosensitive materials used in photoconductive films and the reduction of dark decay of latent images formed therein.

BACKGROUND ART

There are several known electrophotographic methods for the reproduction of images. One common technique is to expose a photosensitive material to an imagewise pattern, thus forming a latent image of the pattern of illumination in the photosensitive material. For instance, in xerography an electrostatic image comprised of static electrical charges is formed on a photoconductive insulator. In another electrophotographic reproduction process a latent electroconductive image is formed in a photoconductive insulator which exhibits the property of persistent conductivity. Such a process is taught by Shely in U.S. Pat. Nos. 3,563,734 and 3,764,313.

A photoconductive or recording element used in a xerographic or persistent conductivity process typically has a multi-layered construction. The base layer or conductive underlayer is a sheet of metal, such as aluminum, or other conductive material. In some instances it may be paper with a thin metallic or conductive resin coating located on the same side of the paper as the photoconductive film or imaging layer. This layer typically comprises a photosensitive material, such as zinc oxide, lead sulfide, cadmium sulfide, selenium or combination thereof, dispersed in a resinous binder. The photoconductive film is typically either coated directly atop the conductive underlayer, or on a dielectric layer disposed between the conductive layer and the photoconductive layer. In some instances, such as where cadmium sulfide is used as the photosensitive material, a dielectric layer may be disposed over the photoconductive film.

When used to make an electrophotographic reproduction, a photoconductive element as described above is exposed to an image or pattern. Initially resistive, the areas of the sheet which are illuminated are rendered more conductive, while the areas which are shaded or not exposed remain relatively resistive. The element is tuus rendered differentially conductive across its face with variations in conductivity representing the latent image.

The latent image of induced conductivity immediately begins to dissipate due to a phenomenon known as "dark decay", i.e., the natural return of an exposed but undeveloped latent image to the condition of the adjacent background area, which is a function of time. The rate of dark decay is affected by such factors as temperature, humidity, and electrical charge induction.

Some dark decay is acceptable, i.e , the latent image retains sufficient contrast of conductivity to be developed. However, if sufficient time passes, the latent image will become too weak to be developed. The phenomenon of dark decay thus limits the time which may be allowed to elapse between formation and development of the latent image. Many electrophotographic reproductions are performed by exposing the photoconductive element with a scanning action, therefore some portions of the latent image are formed before others. A relatively rapid rate of dark decay restricts the size of a photoconductive element which can be imaged with such a scanning action because the first portion of the latent image formed begins to dissipate immediately and may have undergone unacceptable dark decay before the scanning exposure of the entire plate is completed and development is begun. Alternatively, the photoconductive element may be made with photosensitive materials with slower rates of dark decay, for instance, silver halides. Such photosensitive materials are typically more expensive than materials such as zinc oxide, lead sulfide, or cadmium sulfide.

Many photosensitive materials used in photoconductive elements typically have a limited spectral response which does not coincide with the white light region of the electromagnetic spectrum where many commonly used lightwise exposure sources have their maximum output. For instance, the spectral sensitivity of zinc oxide is confined essentially to ultraviolet wavelengths. It is normally desirable for the recording element to be sensitive to light within the region of the electromagnetic spectrum where the exposure source is most powerful.

It is well known in the art to modify the spectral sensitivity of electrophotographic materials to desired wavelengths of radiation with selected spectral sensitizing dyes. In the case of a recording element, the dye or combination of dyes is typically incorporated in the photoconductive film. Apparently the dye molecules become adsorbed on the surface of the particles of photosensitive material in such a manner that photoelectrons generated by the dye molecules in response to the radiation emitted by the exposure source are transferred to the conduction band of the photosensitive material. (Page 352, Schaffert, *Electrophotography,* 2d Edition, Wiley & Sons, New York, N.Y., 1975). The dyes that have been found useful for altering the spectral sensitization of, for example, zinc oxide include: azomethine dyes, cyanine dyes, fluorescein dyes, rosaniline dyes, erythrosin dyes, rose bengal, bromophenol blue, basic fuchsin, methyl green, methylene blue, etc. Several of these dyes are more fully described in U.S. Pat. Nos.: 2,959,481; 3,051,569; 3,128,179; 3,274,000; 3,346,161; 3,403,023; 3,469,979; 3,619,154; 3,682,630; 3,867,144; and 4,418,135.

One disadvantage with sensitizing dyes is that many are hazardous or toxic materials. For instance, Rhodamine B, a dye commonly used to spectrally sensitize zinc oxide, is identified as a carcinogen in the Aldrich Material Safety Data Sheet on CAS #81-88-9 published by Aldrich on Sept. 14, 1984. In addition, many of the dyes are in the form of fine powders. Particulates in the air are increasingly viewed as a potential health hazard.

Another disadvantage is that if a high dye loading is necessary to achieve a desired photospeed, the photoconductive film may be colored or tinted. This effect is unacceptable if the photoconductive film is part of a final copy, as on coated paper, fo instance. Also, high loadings of spectral sensitizing dyes such as Rhodamine B may lead to poor adhesion of the photoconductive layer to the base layer.

Further, in many instances the spectral sensitization and photospeed of a photoconductive film may be expanded only a limited degree before the film becomes saturated with sensitizing dye. Once this point is reached, the incorporation of greater amounts sensitizing dye will yield little or no change in photosensitivity.

Therefore, there is a need in the electrophotographic reproduction field for a photoconductive film with a reduced rate of dark decay of latent images and an increased spectral sensitization at a reduced spectral sensitizing dye loading.

SUMMARY OF INVENTION

This invention provides a photoconductive film that has been supersensitized to spectral sensitizing dyes and has a reduced rate of dark decay. As used herein, "supersensitized" refers to an increase in sensitivity to an extent far surpassing that expected by the use of a particular sensitizing dye. This invention also provides a method for forming such films.

Briefly summarizing, the method of the invention comprises the incorporation of an effective amount of an organic acid having at least one carboxyl functional group and at least one hydroxyl functional group in a photoconductive film coating mixture to thereby supersensitize the resultant film of the invention and reduce the dark decay rate thereof.

DETAILED DESCRIPTION OF INVENTION

It has been found that adding an effective amount of an organic acid having at least one carboxyl functional group and at least one hydroxyl functional group to the coating mixture of photosensitive material and binder resin causes the resultant film to have a higher photospeed, lower rate of dark decay, and greater sensitivity to spectral sensitizing dyes than would be achieved without use of the organic acid.

Importantly, the organic acid is an independent component of the coating mixture and is substantially not copolymerized with the binder resin. It has been observed that photoconductive films formed from coating mixtures in which an organic acid of the type disclosed herein has been copolymerized with the binder resin to become a part thereof do not exhibit the desired supersensitivity or reduced rate of dark decay, whereas photoconductive films formed from coating compositions containing otherwise similar binder resins wherein the organic acid is substantially not copolymerized with the binder resin exhibit improved photosensitivity and reduced dark decay. For example, a photoconductive film formed from a coating composition wherein the binder resin is a styrene/isooctyl acrylate copolymer (60/40 weight ratio) and which further contains acetic acid will, according to the present invention, exhibit a higher sensitivity to spectral dyes and lower rate of dark decay than will a photoconductive film formed from a coating composition which contains no free acetic acid and wherein the binder resin is a styrene/isooctyl acrylate/acetic acid terpolymer (60/40/0.25 weight ratio).

It is not understood what the interaction between the combination of carboxyl functional groups and hydroxyl functional groups and the particles of photosensitive material is, but it is believed to encompass a synergistic reaction involving the two functionalities, because compounds containing either of the functional groups alone will not cause the supersensitivity to spectral sensitizing dyes or reduction of dark decay rate which are objects of this invention.

Acids having an approximately 1:1 mole ratio of hydroxyl functional groups to carboxyl functional groups, such as acetic acid, methacrylic acid, and acrylic acid, are preferred, but acids having other ratios will work. For instance, malonic acid and citric acid which have ratios of approximately 2:1 and 3:1, respectively, may also be used to attain the benefits of this invention. Typically, as the ratio gets higher than 3:1 or substantially less than 1:1, the acid becomes less efficient in providing the benefits of this invention.

The most effective supersensitizing agents were found to be acrylic acid and methacrylic acid. However, both of these acids are somewhat unstable and subject to self-polymerization which tends to inhibit the desired sensitization effect. Acrylic and methacrylic acids may be stabilized with the addition of stabilizing compounds if kept refrigerated, however, these compounds typically interfere with the reaction between the organic acid and the other constituent elements of the photoconductive film to inhibit attainment of the advantages of this invention. The most preferred supersensitizing agent is typically acetic acid because it is more stable and easier to handle than either acrylic acid or methacrylic acid.

Zinc oxide is a well-known photosensitive material commonly used, for instance, in persistent conductivity electrophotographic reproduction processes. Photoconductive zinc oxide readily reacts with moisture and carbon monoxide in the air to form nonphotoconductive zinc carbonate. When the zinc oxide particles are dispersed throughout the binder resin and a film is formed, this reaction is prevented. However, until the film is formed, i.e., during storage or preliminary processing, the zinc oxide may so react. An increasing proportion of zinc carbonate causes a reduction in photosensitivity of the resultant film. Spectral sensitizing dyes may be used to improve the photosensitivity of the film, but as the level of zinc carbonate increases, it becomes increasingly difficult to compensate for the reduced photospeed. A zinc carbonate level of about 0.09 percent by weight of zinc oxide is typically considered the maximum acceptable limit for commercial use.

According to this invention, incorporation of an effective amount of an organic acid as described above in the coating composition reduces the rate of dark decay and increases photosensitivity of the resultant film. One possible explanation for the improved photosensitivity and reduced rate of dark decay is that the addition of the acid to the coating composition converts the nonphotoconductive zinc carbonate to photoconductive zinc oxide. Usually only very small amounts of zinc carbonate will remain, typically less than 0.01 percent by weight of zinc oxide.

However, the mechanism by which the photosensitivity and rate of dark decay are improved involves more than simply reducing the amount of zinc carbonate in the film. Incorporation of an organic acid as described above in a coating composition containing "fresh" zinc oxide, i.e., zinc oxide which is contaminated with little or no zinc carbonate, leads to substantial improvements in photosensitivity and rate of dark decay over photoconductive films made from coating compositions containing similar zinc oxide but none of the organic acid disclosed herein. In some instances, the amount of dye required to achieve a certain photospeed may be reduced by a factor of 30.

Another important and unexpected benefit is that incorporation of an organic acid as described above has the effect of reducing the rate of dark decay of a latent image in the photoconductor film. The rate of dark decay may be decreased such that periods of greater than 30 seconds may elapse before the same amount of dark decay occurs as does in four seconds in films which do not contain the organic acid. Because of the reduced rate of dark decay, a longer period may elapse between formation of the latent image and development thereof. Thus larger sheets may be imaged in a scanning fashion. Newspaper printers, for example, who use large photoconductive sheets will find this a useful advantage. As a further advantage afforded by reducing the rate of dark decay, the photosensitive sheet may be exposed with smaller scanning segments thus improving image resolution. Other advantages afforded by the reduced rate of dark decay will be obvious to those skilled in the art.

Copending U.S. Pat. Application Ser. No. 887,073, commonly assigned herewith and filed on July 17, 1986, now abandoned is incorporated herein by reference and discloses a binder resin for photoconductive films which comprises a copolymer of styrene and at least one alkyl acrylate, the alkyl group of which comprises from four to twelve carbon atoms. For a photoconductive film comprising zinc oxide dispersed in a styrene/isooctyl acrylate copolymer, incorporation of from about 0.02 to about 0.30 weight percent of acetic acid based on the dried solids in the film has been found advantageous. The best combination of photosensitivity, dark decay, and solution viscosity was found when the acetic acid content was about 0.14 weight percent.

Similarly, when acetic acid is incorporated in a coating composition of cadmium sulfide dispersed in a styrene/butadiene copolymer, the electrical contrast of latent images formed in the resultant photoconductive film is enhanced.

Titanium dioxide is an additional pigment commonly employed in photoconductive films containing zinc oxide so that several copies may be made from the same film without re-exposure, a performance characteristic referred to as memory. The proportion of titanium dioxide is usually small relative to that of zinc oxide, there typically being approximately six to seven parts by weight of zinc oxide for each part of titanium dioxide. Addition of one or more of the above-defined organic acids has not been observed to have any apparent effect on the titanium dioxide or the amount thereof required to achieve desired memory performance.

One advantage of this invention is that incorporation of an organic acid as heretofore discussed has the unexpected effect of increasing the photosensitivity of or "supersensitizing" the photoconductor film. Because of this effect, a lesser amount of a particular spectral sensitizing dye is necessary to achieve a desired photosensitivity. Unexpectedly, with this invention, even photoconductive films containing zinc oxide, but no spectral sensitizing dyes, can be exposed with white light to form a latent image.

Higher dye loads can typically be used to achieve higher photospeeds. Above the saturation point, however, an increase in the dye load does not yield a useful increase in photosensitivity. Although dye saturation occurs at approximately the same dye load as in prior constructions, the addition of an organic acid according to this invention has the effect of increasing the photospeed achieved by that dye loading.

Specific dyes are chosen to sensitize a photoconductive film to desired wavelengths. Selection of spectral sensitizing dye(s) when formulating a photoconductive film requires a balance among several factors, such as the wavelength of spectral sensitization, safety of component materials and fabrication process, shelf life or stability of fabricated films, cost of raw materials, processing ease, consistency of product from batch to batch, required light from exposure source, and light losses or color aberrations in optical elements. Proper selection of sensitizing dye(s) is essential to ensure that a recording element is sufficiently sensitive to a desired imaging light source. Previously known films were typically only capable of being imaged with high power light sources. Weak lasers, for example, were not powerful enough to be used as light sources. With the faster photospeeds achieved by the present invention, less powerful light sources may be used. For example, when an organic acid is incorporated in the photoconductive film according to this invention, Bromophenol Blue may be used to sensitize a zinc oxide photoconductor to alter the spectral sensitivity of the film to coincide with the radiation emitted by inexpensive low power lasers or laser diodes, a phenomenon not previously available.

Several other benefits are achieved by supersensitization of a photoconductive film according to this invention. Such films may be made more economically because an effective amount of acetic acid is typically less expensive than equivalent amounts of sensitizing dye(s). The formation of photoconductive films will be safer because lesser amounts of hazardous dyes may be used to achieve desired photospeeds and a number of less hazardous alternative dyes may now be used. The novel method increases the number of dyes which are suitable as sensitizing agents and can therefore be considered viable alternatives, thereby providing greater flexibility in the formulation of a photosensitive film.

Furthermore, addition of an organic acid as discussed above may have the effect of advantageously altering the viscosity of the resin/photoconductor coating composition with certain binder resins. For example, when binder resin is a styrene/isooctyl acrylate copolymer, incorporation of an organic acid according to the invention typically reduces the viscosity of the composition thereby rendering it easier to mix. In addition, the coating process is facilitated by faster and more uniform mixing of the coating components without disturbing the particle size distribution of the photosensitive material.

Alternatively, certain low molecular weight styrene/butadiene copolymers typically produce coating compositions with undesirably low viscosities which cannot maintain proper dispersion of the photosensitive material and pigments when a film is cast. Incorporation of an organic acid as disclosed herein in such a composition has been unexpectedly found to increase the viscosity of the mixture, thereby improving the uniformity of dispersion as the film is cast.

The effect that incorporation of an organic acid as disclosed herein will have on the viscosity of a particular coating composition may be readily determined by experiment. Optimum viscosity is determined in part by such factors as which coating process is used to cast a photoconductive film, the speed at which the film is cast, and the percent solids of the coating composition used.

The order of mixing of the various components of the coating composition is not critical to achieving the benefits of this invention. Typically, the acid is preferably first added to the solvent, commonly toluene, because this sequence of preparation will often make subsequent processing of the composition easier. One convenient method of preparation is to mix the solvent and the acid, and then combine that solution with the binder resin and photosensitive pigments. The mixture may be blended in a homogenizer to uniformly disperse the pigments and acid throughout the resin matrix. Alternatively, a ball mill, colloid mill, or other similar apparatus familiar to those skilled in the art may be used. Typically the most convenient point to add the spectral sensitizing dye to the dispersion is after the pigments have been uniformly dispersed throughout the resin. The dye-sensitized coating composition is then cast by conventional techniques to form a photoconductive film.

The utility of this invention will be further explained by the following nonlimiting examples. All amounts are parts by weight unless otherwise specified.

COMPARATIVE EXAMPLE A AND EXAMPLES 1–7

Comparative Example A and Examples 1–7 illustrate the effect upon photosensitivity achieved by incorporating each of the indicated additives in a photoconductive film comprising zinc oxide, titanium dioxide, and Rhodamine B dispersed in a styrene/butadiene copolymer.

The composition of the coating composition for each film was as follows:

| Component | Amount |
|---|---|
| Styrene/Butadiene Copolymer | 13.3 parts |
| Zinc Oxide (USP 20, pharmaceutical grade, available from New Jersey Zinc Company) | 75.5 parts |
| Titanium Dioxide (Horsehead A430, formerly available from Gulf & Western Natural Resources Group) | 11.1 parts |
| Rhodamine B Sensitizing Dye (available from Aldrich Chemical Company) | 0.073 parts |
| Toluene | 97 parts |
| Methanol | 3.4 parts |
| Additive | As Indicated In Table I |

The film in Comparative Example A was prepared as follows. The styrene/butadiene binder was dissolved in the toluene with a magnetic stirrer and the solution then passed once through a Gaulin Model 15M8BASMD Homogenizer, available from the Manton-Gaulin Manufacturing Company, Inc., operated at a pressure of 4000 pounds per square inch. The pigments, i.e., zinc oxide and titanium dioxide, were then added to the solution, and the mixture was again passed through the homogenizer to uniformly disperse the pigments throughout the binder. After homogenizing, the Brookefield viscosity was measured. The sensitizing dye was then dissolved in the methanol and mixed with the homogenized dispersion to complete the coating composition.

The coating composition was then cast on the top side of a sheet of polyester approximately 0.9 mil thick, having a dielectric constant of approximately 4.0 and a layer of vapor coated aluminum on the bottom side. The sheet was fed through a knife coater at a speed of approximately 10 feet per minute and dried by passing through a 25 foot long oven, the maximum temperature of which was approximately 196° F., to form a film having an approximate thickness of 25 microns when dry. Upon exit from the oven, the film was wound upon a core.

The films in Examples 1–7 were prepared according to the same proportions and methods as in Comparative Example A, except that amounts of the additives indicated in Table I were added to the toluene after the binder was dissolved therein, but before addition of the pigments.

Each prepared film was then tested on a Pyrofax Brand Platemaker Model MR-404, available from the Minnesota Mining and Manufacturing Company. Samples of each film were exposed for different times to determine the time required to obtain an open 3 exposure on a reflection gray scale having an optical increment or step density of approximately 0.15.

The results obtained are shown in Table 1. An increase in viscosity of the coating compositions of the films in Examples 1 and 3–7 relative to that of the coating composition in Comparative Example A was observed which, because of the low viscosity of styrene/-butadiene coating compositions, aided the film coating process. An improved photosensitivity, indicated by reduced exposure time, was most noticeable in the films in Examples 3–7 wherein the sensitizing additive was an acid which contained both carboxyl and hydroxyl functional groups. As illustrated in Example 1, the salt of such an acid had no apparent effect on photosensitivity. As illustrated in Example 2, the incorporation of an additive, sulfuric acid, having only hydroxyl but not carboxyl functional groups had only a limited effect on photosensitivity.

TABLE I

| Example | Additive | Amount of Additive (Parts) | Brookefield Viscosity After Homogenizing (Centipoise) | Exposure Time (Seconds) |
|---|---|---|---|---|
| A | None | — | 65 | 30 |
| 1 | Sodium Acetate | 0.13 | 295 | 30 |
| 2 | Sulfuric Acid | 0.10 | 45 | 24 |
| 3 | Malonic Acid | 0.10 | 120 | 20 |
| 4 | Acrylic Acid | 0.10 | 265 | 16 |
| 5 | Acrylic Acid | 0.20 | 255 | 18 |
| 6 | Acetic Acid | 0.10 | 242 | 18 |
| 7 | Methacrylic Acid | 0.10 | 230 | 14 |

COMPARATIVE EXAMPLE B AND EXAMPLES 8–11

Comparative Example B and Examples 8–11 illustrate the effects upon photosensitivity and rate of dark decay achieved by incorporating different amounts of acetic acid in a photoconductive film at a constant sensitizing dye loading.

The composition of the coating composition of each film was as follows:

| Component | Amount |
|---|---|
| Styrene/Isooctyl Acrylate | 13.3 parts |
| Zinc Oxide (USP 20) | 75.5 parts |
| Titanium Dioxide (Horsehead A430) | 11.1 parts |
| Rhodamine B | 0.0014 parts |
| Acetic Acid | As Indicated In Table II |
| Toluene | 97 parts |

-continued

| Component | Amount |
|---|---|
| Methanol | 3.4 parts |

The films were each prepared according to the method used in Examples 1–7, except that styrene/isooctyl acrylate was substituted for styrene/butadiene as the binder resin. The utility of the former copolymers as binder resins is disclosed in the aforementioned application Ser. No. 887,073 now abandoned. The Brookefield viscosity of each coating composition was measured both before and after homogenizing. The film in each example was evaluated according to the method in Examples 1–7 and Comparative Example A to determine the exposure times shown in Table II. The dark decay of each film was also evaluated with the Pyrofax unit. For each film a control sample was made by exposing the film and developing it normally. A second sample was then exposed according to the same conditions, but 10 seconds were allowed to elapse before it was developed. The grey scale of the first exposure was then compared to that of the second to note the change in grey scale reading, i.e., steps of dark decay.

The results obtained are shown in Table II. The addition of a small quantity acetic acid resulted in a profound lowering of the viscosity of the coating composition. Coating mixtures containing increasing amounts of acetic acid were observed to have somewhat less dramatic reductions in viscosity, however, the photoconductive films formed therefrom exhibited increased photosensitivity and reduced dark decay.

TABLE II

| Example | Amount of Acetic Acid (Parts) | Brookefield Viscosity (Centerpoise) Before Homogenizing | After Homogenizing | Exposure Time (Seconds) | Dark Decay (Steps) |
|---|---|---|---|---|---|
| B | 0.00 | 31,700 | 1,970 | 25.0 | 1½ |
| 8 | 0.02 | 140 | 60 | 6.0 | ¾ |
| 9 | 0.10 | 990 | 520 | 2.1 | 0 |
| 10 | 0.18 | 3,53, | 990 | 2.2 | 0 |
| 11 | 0.26 | 3,580 | 1.440 | 3.0 | 0 |

EXAMPLES 12–19

Examples 12–19 illustrate the effects upon photosensitivity and dark decay rate achieved by incorporating different amounts of acetic acid in photoconductive film coatings mixtures with varying sensitizing dye loadings.

The composition of the coating composition of each film was as follows:

| Component | Amount |
|---|---|
| Styrene/Isooctyl Acrylate | 13.3 parts |
| Zinc Oxide (USP 20) | 75.5 parts |
| Titanium Dioxide (Horsehead A430) | 11.1 parts |
| Rhodamine B | As Indicated In Table III |
| Acetic Acid | As Indicated In Table III |
| Toluene | 97 parts |
| Methanol | 3.4 parts |

The films were each prepared and evaluated according to the methods used in Examples 8–11 and Comparative Example B.

The results obtained are shown in Table III. Addition of acetic acid resulted in a substantial reduction of the viscosity of the coating composition and in the exposure time required to achieve an open 3 exposure. Increasing the sensitizing dye loading further increased the photosensitivity in each case. Dark decay was negligible at acetic acid quantities of about 0.02 parts and higher.

TABLE III

| Example | Acetic Acid (Parts) | Dye Loading (Parts) | Brookefield Viscosity (Centipoise) Before Homogenizing | After Homogenizing | Exposure Time (Seconds) | Dark Decay (Steps) |
|---|---|---|---|---|---|---|
| 12 | 0.02 | 0.037 | 61,600 | 1,080 | 14 | ½ |
| 13 | 0.02 | 0.049 | 61,600 | 1.080 | 8 | ½ |
| 14 | 0.10 | 0.037 | 1,440 | 960 | 2.1 | 0 |
| 15 | 0.10 | 0.049 | 1,440 | 960 | 1.9 | 0 |
| 16 | 0.18 | 0.037 | 8,800 | 1,030 | 1.9 | 0 |
| 17 | 0.18 | 0.049 | 8,800 | 1,030 | 1.7 | 0 |
| 18 | 0.26 | 0.037 | 9,900 | 940 | 2.9 | 0 |
| 19 | 0.26 | 0.049 | 9,900 | 940 | 1.9 | 0 |

EXAMPLES 20–24

Examples 20–24 illustrate the effects upon photosensitivity and rate of dark decay achieved by incorporating varying sensitizing dye loadings in a photoconductive film coating composition containing acetic acid.

The composition of the coating composition of each film was as follows:

| Component | Amount |
|---|---|
| Styrene/Isooctyl Acrylate | 13.3 parts |
| Zinc Oxide (USP 20) | 75.5 parts |
| Titanium Dioxide (Horsehead A430) | 11.1 parts |
| Acetic Acid | 0.0014 parts |
| Rhodamine B | As Indicated In Table IV |
| Toluene | 97 parts |
| Methanol | 3.4 parts |

The films were each prepared and evaluated according to the method used in Examples 8–19.

The results obtained are shown in Table IV. As expected, increasing dye load led to shorter exposure times to obtain an open 3 exposure. In all instances, dark decay was negligible. Unexpectedly, an exposure was achieved in a film (Example 20) containing no sensitizing dye. Previously because of a reciprocity failure, exposure of a film containing no sensitizing dye could not be achieved.

TABLE IV

| Example | Dye Loading (Parts) | Exposure Time (Seconds) | Dark Decay (Steps) |
|---|---|---|---|
| 20 | 0.0 | 240 | 0 |
| 21 | 0.00024 | 13.0 | 0 |
| 22 | 0.0073 | 6.4 | 0 |
| 23 | 0.012 | 4.7 | 0 |
| 24 | 0.017 | 4.0 | 0 |

COMPARATIVE EXAMPLE C AND EXAMPLE 25

Comparative Example C and Example 25 illustrate the unexpected differences in sensitivity to spectral sensitizing dyes and rate of dark decay exhibited by a photoconductive film of the invention (i.e., Example 25) wherein an organic acid as defined herein is incorporated within the coating composition as an independent component thereof and an otherwise similar photoconductive film (i.e., Comparative Example C) wherein the organic acid is a moiety copolymerized within the binder resin.

The coating compositions for the films in each example were made as follows. Thirteen and three tenths parts of the indicated binder resin were dissolved with a mechanical stirrer in a sufficient amount of toluene to provide a final coating composition totaling about 60 weight percent solids. To make the film in Example 25, 0.20 part of acrylic acid was also added to the resin/toluene solution. To this solution, 75.5 parts of zinc oxide (USP 20) and 11.1 parts of titanium dioxide (Horsehead A430) were added while stirring continuously. The dispersion was blended by passing once through a Gaulin Model 15M8BASMD Homogenizer being operated at a pressure of 4,000 pounds per square inch. The indicated amount of Rhodamine B was dissolved in 3.4 parts of methanol, and that solution then mixed with the homogenized dispersion to yield the final coating composition.

Comparative Example C was made with a styrene/isooctyl acrylate/acrylic acid terpolymer (60/40/0.25 weight ratio) and 0.22 part Rhodamine B, and Example 25 was made with a styrene/isooctyl acrylate copolymer (60/40 weight ratio) and 0.073 part Rhodamine B.

Photoconductive films were then cast from the coating compositions as in Examples 1–7.

The photospeed of each of the films was determined by evaluating the time required to obtain an open 3 exposure as in Examples 1–7, with the following results being obtained:

TABLE V

| Example | Sensitizing Dye (Parts) | Time (Seconds) |
|---|---|---|
| C | 0.22 | 180 |
| 25 | 0.073 | 18 |

As shown by these results, the film in Example 25, which contained a styrene/isooctyl acrylate binder resin and was made according to the present invention, required merely one tenth the time to obtain a standard exposure as did the film in Comparative Example C, which contained an organic acid as a copolymerized part of the binder resin and three times as much spectral sensitizing dye.

Various modifications and alterations of this invention will become apparent to those skilled in the art without departing from the scope and spirit of this invention.

What is claimed is:

1. A supersensitized photoconductive film comprising a dispersion of a resinous binder, at least one photosensitive material, and an effective amount of at least one organic acid which has at least one carboxyl group and at least one hydroxyl group, wherein said organic acid is substantially not copolymerized with said binder resin.

2. The supersensitized photoconductive film of claim 1 wherein said organic acid is selected from the group consisting of acrylic acid, methacrylic acid, acetic acid, malonic acid, and citric acid.

3. The supersensitized photoconductive film of claim 1 wherein said organic acid has a mole ratio of hydroxyl functional groups to carboxyl functional groups which is less than about 3:1.

4. The supersensitized photoconductive film of claim 1 wherein said organic acid has a mole ratio of hydroxyl functional groups to carboxyl functional groups which is less than about 1:1.

5. The supersensitized photoconductive film of claim 1 wherein said resinous binder is a styrene/isooctyl acrylate copolymer.

6. The supersensitized photoconductive film of claim 1 wherein said resinous binder is a styrene/butadiene copolymer.

7. The supersensitized photoconductive film of claim 1 wherein said photosensitive material is zinc oxide.

8. The supersensitized photoconductive film of claim 7 wherein said photosensitive material has a concentration of zinc carbonate which is less than about 0.09 weight percent of said zinc oxide.

9. The supersensitized photoconductive film of claim 7 wherein said photosensitive material has a concentration of zinc carbonate which is less than about 0.01 weight percent of zinc oxide.

10. The supersensitized photoconductive film of claim 1 wherein said organic acid is acetic acid and is present at a concentration of from about 0.02 to about 0.30 weight percent of the solids of said film.

11. The supersensitized photoconductive film of claim 10 wherein said concentration is about 0.14 weight percent of the solids of said film.

12. A method for supersensitizing a photoconductive film comprising at least one photosensitive material dispersed in a resinous binder wherein said method comprises the incorporation into the coating composition of said film an effective amount of at least one organic acid which has at least one carboxyl group and at least one hydroxyl group, wherein said organic acid is substantially not copolymerized with said binder.

13. The method of claim 12 wherein said organic acid is selected from the group consisting of acrylic acid, methacrylic acid, acetic acid, malonic acid, and citric acid.

14. The method of claim 12 wherein said organic acid has a mole ratio of hydroxyl functional groups to carboxyl functional groups which is less than about 3:1.

15. The method of claim 12 wherein said organic acid has a mole ratio of hydroxyl functional groups to carboxyl functional groups which is less than about 1:1.

16. The method of claim 12 wherein said resinous binder is a styrene/isooctyl acrylate copolymer.

17. The method of claim 12 wherein said resinous binder is a styrene/butadiene copolymer.

18. The method of claim 12 wherein said photosensitive material is zinc oxide.

19. The method of claim 12 wherein said organic acid is acetic acid and is present at a concentration of from about 0.02 to about 0.30 weight percent of the solids of said film.

20. The method of claim 19 wherein said concentration is about 0.14 weight percent of the solids of said film.

* * * * *

UNITED STATES PATENT AND TRADEMARK OFFICE

CERTIFICATE OF CORRECTION

PATENT NO. : 4,820,620

DATED : APRIL 11, 1989

INVENTOR(S) : DONALD J. CAROLLA

It is certified that error appears in the above-identified patent and that said Letters Patent is hereby corrected as shown below:

Col. 2, line 68, "fo" should be --for--.

Col. 9, line 45, "3,53," should be --3,530--.

Signed and Sealed this

Twentieth Day of February, 1990

*Attest:*

JEFFREY M. SAMUELS

*Attesting Officer*

*Acting Commissioner of Patents and Trademarks*